United States Patent [19]

Blackinton

[11] 4,132,357

[45] Jan. 2, 1979

[54] APPARATUS AND METHOD FOR SPRAY APPLICATION OF SOLVENT-THINNED COATING COMPOSITIONS

[75] Inventor: Roswell J. Blackinton, Walled Lake, Mich.

[73] Assignee: Inmont Corporation, Clifton, N.J.

[21] Appl. No.: 698,838

[22] Filed: Jun. 23, 1976

[51] Int. Cl.[2] ..... B05B 7/16; B05B 17/04

[52] U.S. Cl. ..... 239/11; 118/302; 239/135; 239/290; 239/424; 239/432; 427/377; 427/421

[58] Field of Search ..... 239/1, 3, 8, 11, 13, 239/15, 75, 79, 133–139, 288–288.5, 290, 295, 296, 422, 424, 428, 432, 499, 504; 118/301, 302, 326; 427/377, 378, 421, 422; 98/115 SB

[56] References Cited

U.S. PATENT DOCUMENTS

| | | | |
|---|---|---|---|
| 2,481,813 | 9/1949 | Bede | 118/302 UX |
| 2,644,717 | 7/1953 | Kopperschmidt | 239/134 |
| 2,868,166 | 1/1959 | Brechenmacher | 239/133 X |
| 2,980,786 | 4/1961 | Chilton | 239/135 |
| 3,686,023 | 8/1972 | Edwards et al. | 427/378 X |
| 3,857,511 | 12/1974 | Govindan | 239/11 |

FOREIGN PATENT DOCUMENTS

| | | | |
|---|---|---|---|
| 941708 | 11/1963 | United Kingdom | 239/79 |

*Primary Examiner*—Robert W. Saifer
*Assistant Examiner*—Andres Kashnikow
*Attorney, Agent, or Firm*—Harness, Dickey & Pierce

[57] ABSTRACT

An apparatus and method for the spray application of solvent-thinned coating compositions whereby optimum coverage of a substrate with a liquid film is consistently achieved without incurring sagging, run-off or surface irregularities, such as orange peeling, in spite of wide fluctuations in the temperature and/or humidity of the surrounding atmospheric environment. In accordance with the invention, a shroud is provided which is disposed in encompassing relationship around the spray nozzle to which air is supplied at a controlled temperature and/or humidity which envelopes and becomes entrained in the spray forming a controlled localized atmosphere and achieving a controlled vaporization of solvent from the liquid droplets during the course of their travel from the nozzle to the surface of the substrate being coated.

9 Claims, 4 Drawing Figures

APPARATUS AND METHOD FOR SPRAY APPLICATION OF SOLVENT-THINNED COATING COMPOSITIONS

BACKGROUND OF THE INVENTION

There has been a continuing problem associated with the spray application of solvent-thinned liquid coating compositions due to wide fluctuations in the ambient atmosphere in the spray booth. Liquid coating compositions adapted for spray application are normally thinned with solvent to reduce their viscosity so as to provide for optimum fragmentation or atomization, achieving uniform coverage of the surface of the substrate being coated. The solvent-thinned liquid coating composition suitable for spray application generally has a viscosity which is insufficient to prevent objectionable sagging or running of the liquid film when applied at reasonable thicknesses to vertical surfaces. This problem is overcome by a controlled volatilization of solvent from the liquid droplets in the spray during the course of their travel from the nozzle to the surface of the substrate. The desired degree of vaporization of solvent can be controlled to some extent by a careful blend of organic solvents and by adjusting the distance between the nozzle and the surface being coated.

While the adjustment in the types of solvents employed in organic solvent-thinned coating compositions has overcome problems associated with wide temperature fluctations in the spray booth environment in the past, governmental restrictions on the flash point of such organic solvent paint systems has occasioned problems in achieving satisfactory drying of the spray pattern employing conventional paint spraying equipment. This problem has become particularly pronounced when employing conventional spray equipment for applying water-thinned liquid coating compositions in which the temperature as well as the humidity of the ambient atmosphere in the spray booth materially affect the volatilization of the water from the spray and wherein the water itself is of relatively low volatility in comparison to conventional organic solvents employed for formulating organic solvent-thinned paint systems. During periods of relatively high humidity, considerable difficulty is encountered in applying water-thinned coating compositions in the form of a liquid film on vertical surfaces without incurring an objectionable running or sagging of the liquid film down the painted surface. At extremely high humidity levels, it is almost impossible to satisfactorily spray such aqueous paints due to the minimal vaporization of water from the spray in route to the surface. Attempts to increase the rate of vaporization of water from such aqueous paint systems by utilizing higher pressure atomizing air and positioning the spray gun or nozzle further from the surface to be coated has been found unsatisfactory in many instances and has also been costly due to the loss or carry off of the fine liquid mist particles in the air passing through the spray booth as a result of "overspray".

In recognition of this problem with both organic solvent and aqueous solvent-thinned liquid coating compositions, various techniques have heretofore been proposed including the use of heated pressurized air for effecting an atomization of the coating composition, heating the liquid coating composition itself prior to fragmentation, as well as supplying heated air such as disclosed in U.S. Pat. No. 2,980,786 into the spray pattern at a position forwardly of the nozzle. Neither of the foregoing techniques have been satisfactory from a commercial standpoint in solving the problems associated with the spray application of solvent-thinned coating compositions, and particularly, aqueous paint systems which are being more widely used to reduce organic solvent emissions.

The present invention provides an apparatus and a method for the spray application of solvent-thinned coating compositions, and particularly aqueous paint systems, whereby a controlled degree of vaporization or drying of the liquid droplets in the spray is effected achieving uniform coverage of a substrate with a liquid paint film having a smooth surface and without any objectionable sagging or running of the liquid film in spite of its application in appreciable thicknesses of up to about 2 mils on a dry-film basis.

SUMMARY OF THE INVENTION

The benefits and advantages of the present invention are achieved in accordance with the apparatus aspects thereof by providing a nozzle for discharging a solvent-thinned liquid coating composition or paint in the form of a directionally-oriented spray comprised of a plurality of fine-sized liquid droplets utilizing spray equipment of any of the types well known in the art. A shroud is positioned in encompassing relationship around the nozzle and is formed with a port through which the spray is discharged toward the surface to be coated. The interior of the shroud is connected to a supply of air at controlled conditions which encompass the nozzle and becomes entrained in the spray enveloping the liquid droplets therein. The air supplied to the shroud can be controlled in temperature, as well as humidity, to achieve the desired drying of the liquid droplets in the spray during their transit from the nozzle to the substrate being coated. It is also contemplated that the apparatus of the present invention can employ means for effecting a controlled heating of the liquid coating composition, as well as means for heating the atomizing air of a conventional air type spray gun to further assist in effecting a controlled drying of the droplets in the spray pattern.

In accordance with the method aspects of the present invention, a solvent-thinned liquid coating composition is spray-applied in the form of a directionally-oriented spray of fine-sized liquid droplets toward a surface to be coated and the spray is encompassed in the vicinity of its origin within a shroud connected to a supply of air at a controlled temperature and/or humidity under low pressure and high flow rate in a manner so as to encompass the nozzle as well as to become entrained in the spray, whereby a controlled vaporization of a desired portion of the solvent in the liquid droplets is effected during the course of their travel from the nozzle to the substrate. The shrouding of the nozzle is performed so as to preclude any appreciable entrainment of surrounding air through a venturi effect into the initial portion of the spray pattern, thereby avoiding dilution of the secondary controlled air supplied to the shroud.

The apparatus and method of the present invention are adaptable to spray nozzles and spray guns of the various types well known and in commercial use including conventional air atomization spray guns, spray guns and nozzles, airless spray guns and nozzles, electrostatic spray guns and nozzles, including manual, hand-held as well as automatic versions thereof. The apparatus and method further contemplate the provisions of baffles and/or controlled inlet conduits to achieve a desired flow pattern of the secondary controlled air introduced into the shroud and to further avoid any undesirable distortion of the spray pattern discharged from the nozzle. A heating of the atomizing air, as well as of the liquid coating composition itself, is contemplated but ordinarily not necessary.

Additional benefits and advantages of the present invention will become apparent upon a reading of the description of the preferred embodiments taken in conjunction with the accompanying drawing.

DESCRIPTION OF THE PREFERRED EMBODIMENTS

Figure 1:
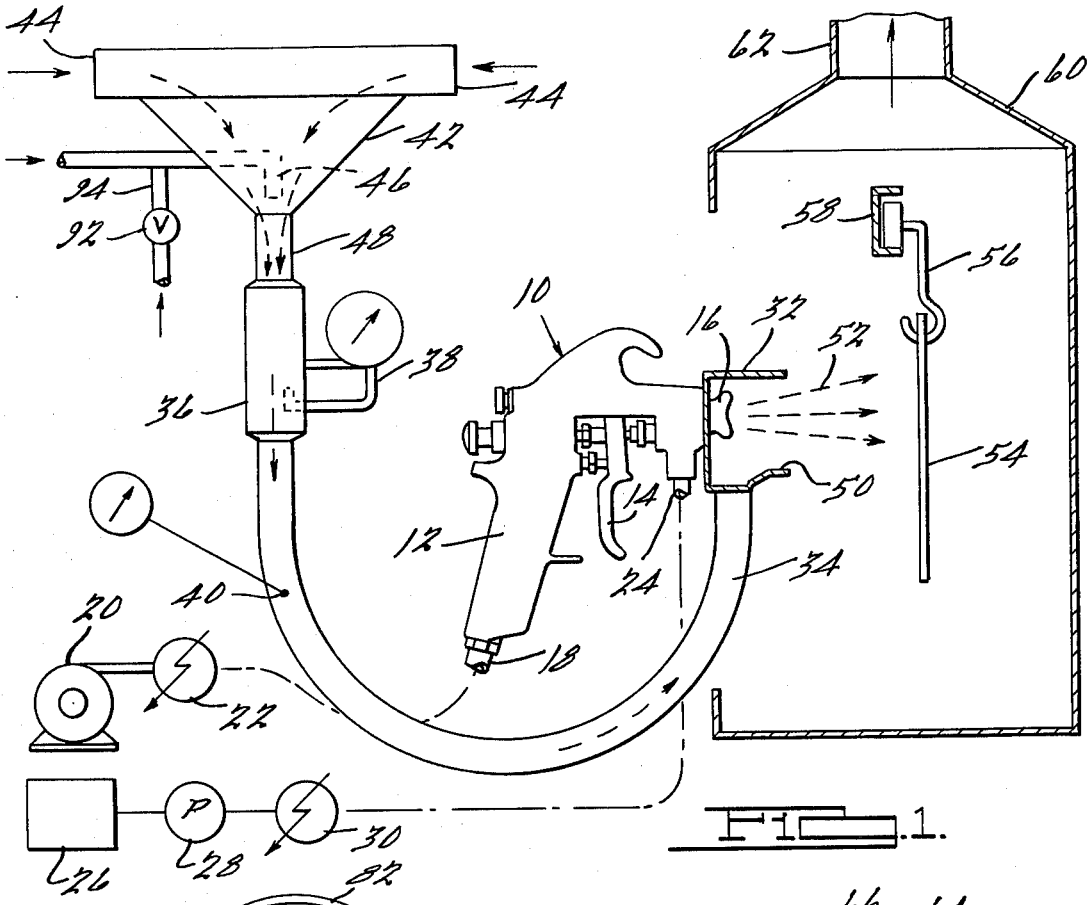
FIG. 1 is a schematic view illustrting the components and their relationship in a spray system embodying the principles of the present invention.

The apparatus and method of the present invention are applicable for use with all solvent-thinned liquid coating compositions or paints which require a thinning with solvent to achieve satisfactory spray application below a viscosity at which sagging would normally occur of a liquid film on a vertical surface were it not for a partial drying of the liquid droplets during transit from the spray gun nozzle to the substrate being coated. The method and apparatus are particularly applicable for spray application of aqueous solvent-thinned paint compositions since the drying rate of the fragmented spray is affected not only by temperature, but also by humidity of the ambient air and since such formulations necessitate appreciable quantities of water as a solvent, such as at least 80% of water of the total solvent present, little latitude is available for adjusting solvent composition to provide for variations in drying rate. Broadly stated, aqueous liquid coating compositions or water-base paints can be defined as those which are water-thinnable and may be of the emulsion-type, of the latex type comprising solid particles suspended in an aqueous medium, as well as water soluble or colloidal suspensions of the vehicle constituent of the coating in an aqueous solvent, which may additionally contain portions of miscible organic solvents. Typical of the foregoing are acrylic-type enamels comprising a resin containing carboxyl groups which are neutralized with an amine to provide or impart water solubility to the organic resin, enabling stable compositions employing as little as 20% organic solvent with the balance water. Ordinarily, such water thinnable acrylic enamel paints must be thinned to a nonvolatile or solids concentration of from about 25% up to about 28% to attain a viscosity of 50 centipoises at which viscosity level satisfactory spray patterns can be achieved employing conventional spray nozzle equipment. However, a viscosity in the order of about 4,000 centipoises corresponding to a nonvolatile or solids content of about 32% is necessary in order to prevent objectionable running or sagging of a liquid coating or film of this aqueous water-thinnable paint. It is apparent, therefore, that a substantial amount of solvent must be volatilized from the liquid droplets in the spray during transit from a nozzle to the surface.

For the purposes of this invention as herein described and as set forth in the subjoined claims, the "no-sag point" is defined as that concentration of nonvolatiles or solids in a solvent-thinned paint or coating composition at which the viscosity of the film is sufficiently high to prevent objectionable running or sagging of the liquid film on a vertical surface which is applied to the desired thickness. The term "gel point" as herein employed and as set forth in the subjoined claims is defined as that concentration of nonvolatiles or solids in a solvent-thinned paint formulation wherein the viscosity of the liquid film is so high that proper leveling of the film does not occur during spray application resulting in surface roughness of a type generally referred to as "orange peel". It will be appreciated from the foregoing that the controlled drying of the liquid droplets in the spray must be performed so as to control the nonvolatile contents of the liquid droplets striking the surface of the substrate within a range of from the no-sag point up to the gel point of that specific coating formulation.

The foregoing limits will vary from one coating formulation to another depending on its composition and characteristics of the vehicle employed, as well as the thickness of the liquid film desired. In automotive application of acrylic enamels, for example, a dry film (solvent-free) thickness of about 1.5 up to about 2.5 mils (0.0015 to 0.0025 inch) is required, necessitating the application on a wet basis of a liquid film ranging from about 6 up to about 10 mils thick. Thicknesses of such magnitude are normally applied in the form of a series of successive spray applications such as about four successive spray applications, each of about 1½ up to 2½ mils thick.

While the present invention is particularly applicable for spraying water-thinnable paints of the aforementioned type benefits are also achieved in the spray application of conventional organic solvent liquid coating compositions in which it is normally necessary to employ upwards of 25% of the total solvent present of fast evaporating solvents, such as acetone, methyl ethyl ketone, methyl isobutyl ketone, ethyl acetate, toluene, and the like. The inclusion of such fast evaporating organic solvents normally provides the requisite drying of the liquid droplets in the spray during transit from the spray nozzle to the surface. Problems nevertheless are encountered as a result of extreme temperature fluctuations of the spray environment, causing inadequate or excessive drying of the spray droplets or necessitating constant adjustments in solvent mix to maintain satisfactory performance. The increasing number of governmental restrictions on the use of organic solvents due to flammability and toxicity has in many instances reduced the latitude of organic solvent selection to achieve satisfactory performance and has further aggravated the problems heretofore associated with the spray application of such paints. While the relative drying rate of the spray of organic solvent paint systems is independent of humidity level, satisfactory control of drying rates is achieved by a control of the temperature of the secondary air introduced into the shroud encircling the nozzle in accordance with the arrangement and for the purpose as hereinafter more fully described.

Referring now in detail to the drawing and as may be best seen in FIG. 1, the system for spray application of solvent thinnable liquid coating compositions comprises a spray gun 10 of the conventional air atomization type including a hand-grip 12, a pivotally mounted trigger 14 for controlling discharge of an atomized spray of paint from a mixing nozzle 16. The butt of the hand grip 12 is connected by a hose 18 to a supply of pressurized atomizing air such as a blower 20, which in accordance with a variation of the process may further include a heat exchanger 22 for controlling the temperature of the atomizing air supplied to the spray gun. The forward end portion of the spray gun is connected by means of a conduit 24 to a supply tank containing a solvent-thinned liquid paint 26 and further includes a pump 28 and a heat exchanger 30 as an optional element for controlling the temperature of the liquid paint supplied to the spray gun. Alternatively, the conduit 24 may be connected to a supply tank of paint which is withdrawn by aspiration or suction therefrom.

A cylindrical shroud or collar 32 is removably mounted on the forward portion of the spray gun in encompassing or encircling relationship about the mixing nozzle 16 thereof and is connected at its lower end by means of a lightweight flexible hose 34 to the outlet end of an expansion chamber 36 of a secondary air supply system. A pitot type flow meter 38 and a thermocouple 40 are incorporated in the expansion chamber 36 and hose 34, respectively, for measuring the flow rate and temperature of the air supplied to the shroud.

In accordance with the specific embodiment shown, a heat exchanger 42, such as a steam heated heat exchanger, is formed with a pair of opening inlet ports 44 into which air is drawn by the suction provided by an air injector 46, positioned to discharge into a constricted portion 48 of the supply system. The amount of air drawn into the secondary air supply system is readily regulated by controlling the pressure of the air supplied to the injector as monitored by the flow meter 38. Similarly, the temperature of the secondary air is controlled by the temperature of the steam supplied to the heat exchanger 42 as monitored by the thermocouple 40.

In the schematic arrangement as illustrated in FIG. 1, the shroud 32 is formed with a forwardly directed opening or port 50 through which the spray comprising a plurality of directionally-oriented fine-sized liquid droplets, indicated at 52, passes in combination with the secondary air supplied to the interior of the shroud through the hose 34. The spray 52 is suitably directed against the surface of a workpiece or panel 54 suspended from a hook 56 connected to a conveyor 58 positioned within a vented spray booth 60 formed with a stack 62.

Figure 2:
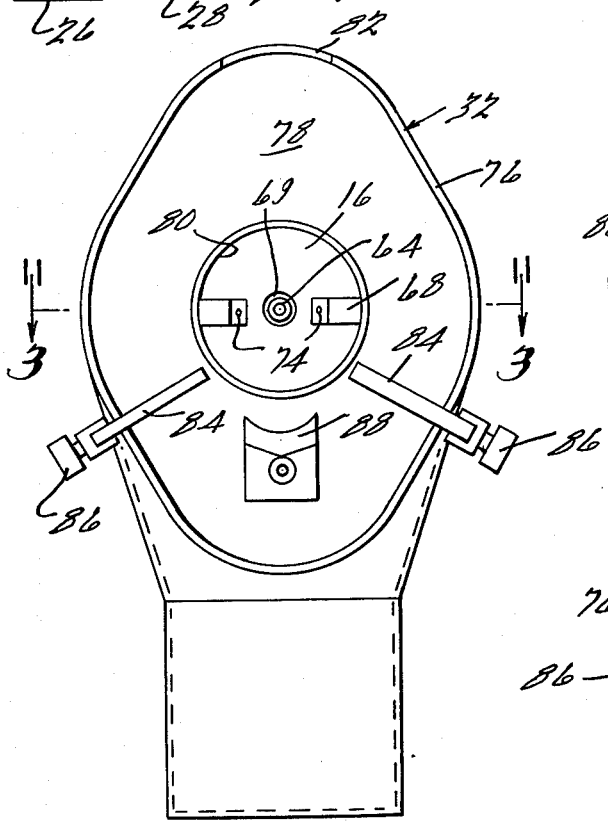
FIG. 2 is an enlarged front elevational view of the nozzle and shroud of the spray gun shown in FIG. 1.
Figure 3:
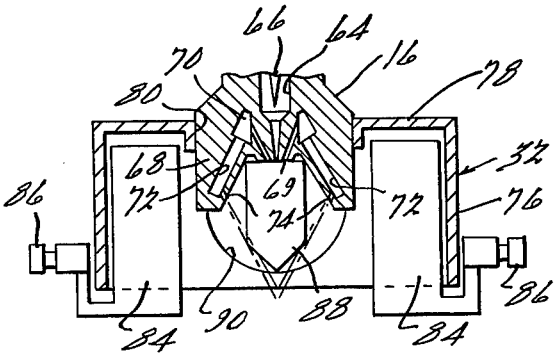
FIG. 3 is a transverse horizontal view through the nozzle and shroud assembly as shown in FIG. 2 and taken substantially along the line 3—3 thereof.

The mixing nozzle 16 of the spray gun, as may be best seen in FIGS. 2 and 3, is of a conventional type and includes an axial chamber 64 in which a needle valve 66 is disposed which is axially reciprocable in response to actuation of the trigger 14 for controlling the discharge of the liquid coating composition from the outlet end of the axial chamber. The mixing nozzle 16 further includes an air atomizing head 68 incorporating an annular port 69 encircling the chamber 64 which is disposed in communication with an annular chamber 70 that is connected to the pressurized source of atomizing air. The high pressure atomizing air discharged from the annular port 69 converges at a point spaced outwardly and forwardly of the discharge point of the axial chamber 64 and effects a fragmentation or atomization of the liquid into a conical spray pattern in a manner well known in the art. A portion of the atomizing air is transferred through communicating angular bores 72 and is discharged from jet orifices 74 formed in diametrically projecting portions of the atomizing head. The particular arrangement illustrated is adapted to produce an atomized spray pattern of a generally fan or eliptical shape oriented in a generally upright direction as viewed in FIG. 2.

It will be understood that alternative satisfactory air atomization nozzle arrangements can be satisfactorily employed as well as so-called "airless spray nozzles" which rely on the use of high hydraulic pressures applied to the liquid paint, such as above 2,000 psi, for example, to effect atomization thereof. The configuration of the spray pattern can also be varied from elliptical or fan shapes to conical configurations of varying divergence in order to achieve optimum coverage of surfaces in accordance with variations in their particular configuration and size.

Figure 4:
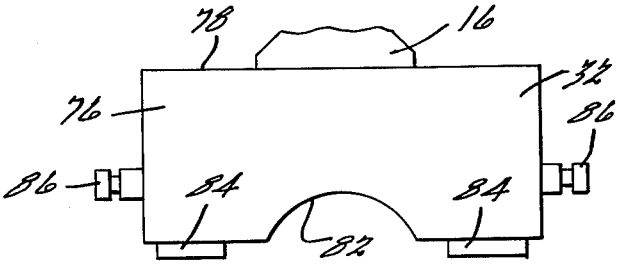
FIG. 4 is a fragmentary plan view of the shroud and forward end of the spray gun shown in FIG. 2.

In any event, the mixing nozzle is encompassed within the shroud 32 comprised of an annular side wall 76 and an end or back wall 78 which is formed with a flanged circular opening 80 in substantially the center portion thereof for slidably overlying and removably engaging the mixing nozzle of the spray gun. The forward edge of the side wall 76 defines the port 50 which projects axially forwardly of the point of atomization of the liquid coating composition. In the specific arrangement shown, the upper edge of the side wall 76, as best seen in FIGS. 2 and 4, is formed with an arcuate recess 82 to provide clearance for unobstructed discharge of the upright fan-shaped spray pattern through the port.

To avoid any undesired disturbance of the spray pattern by the secondary air introduced into the interior of the shroud through the hose 34, a pair of radially and axially extending baffles 84 are adjustably mounted by means of threaded screw clamps 86 at selected locations along the side wall in addition to an axially extending V-shaped baffle 88 mounted directly over the center of an inlet port 90 formed in the lower portion of the side wall of the shroud through which the conditioned secondary air is introduced.

It will be appreciated that the cross sectional configuration of the shroud and the types and numbers of the baffles will vary depending upon the type of spray nozzle employed and the nature of the spray pattern discharged therefrom. In each instance, however, the back wall of the shroud is mounted around the forward portion of the spray gun or nozzle arrangement to substantially preclude the admittance of appreciable quantities of ambient air into the shroud and subsequent entrainment thereof in the spray pattern, which would disturb the controlled drying rate of the liquid droplets of the spray. In the arrangement as illustrated in the drawings, the mixing nozzle is enveloped by the secondary air introduced into the shroud and the spray discharged therefrom effects an entrainment of such secondary air which surrounds the liquid droplets, establishing a controlled localized environment which controls the rate of vaporization of the solvent and partial drying of the liquid droplets. The entrainment of the secondary air into the spray is achieved through a venturi effect, which is of the greatest magnitude at the discharge point of the nozzle and atomizing orifices. The velocity of the liquid droplets rapidly decreases on movement from the nozzle such that subsequent entrainment of air from the ambient atmosphere outwardly of the discharge port of the shroud is small and has only a minor effect on the drying characteristics of the spray which can readily be compensated for by adjustments in the temperature and/or humidity of the secondary air.

The secondary air is supplied to the interior of the shroud at low pressure corresponding to that sufficient to supply the necessary volume of secondary air required to maintain the interior of the shroud filled and to further supply that quantity extracted by the venturi effect which becomes entrained in the spray pattern.

It will be appreciated in accordance with the arrangement as hereinabove described and as shown in the drawing, that a controlled localized spray environment is provided surrounding the nozzle, whereby desired drying characteristics of the liquid paint spray can be effected regardless of the temperature and humidity conditions prevailing in the spray booth. The localized environment created requires only relatively small quantities of secondary air which can readily be heated, cooled, humidified and/or de-humidified as may be required to achieve the desired localized spray environment. Under conditions where the environment prevalent in the spray booth is satisfactory for spray application, the shroud can simply be removed from the forward portion of the spray gun and the system deenergized, enabling operation in accordance with conventional practice. For organic solvent-base paints, a control of the temperature of the secondary air alone will provide appropriate drying conditions of the liquid droplets during their transit from the nozzle to the substrate. In the case of aqueous paint systems incorporating substantial quantities of water as a solvent, a control of temperature alone will ordinarily provide adequate control of the drying speed of the liquid droplets en route to the substrate. Under situations of high temperature and excessively low humidity, excessive drying of the spray may occur resulting in the liquid film passing the gel point. Under such circumstances, a cooling of the secondary air and/or a humidification thereof can be effected to reduce the drying rate of the spray droplets. In such event, moisture can be introduced into the secondary air supply system, such as in the form of steam connected through a valve 92 through a pipe 94 connected to the injector conduit 46. As previously indicated, the atomizing air and the liquid paint itself can be heated to increase the rate of vaporization or to permit a reduction in the quantity of solvent employed at the same viscosity to facilitate in the attainment of optimum liquid coatings. The use of the apparatus and practice of the method of the present invention further permits conventional commercial spray equipment to be adjusted to normal operation for use with aqueous paint systems, rather than the high pressure increased distance arrangement heretofore necessary, whereby a substantial reduction in loss of valuable paint is effected as a result of reduced overspray.

As a typical example of operation, a water-thinnable paint system was employed comprising a thermosettable acrylic polymer having hydroxyl and carboxyl functionality which is made water reduceable or thinnable by neutralization of the carboxyl groups with an organic amine and cross-linking with a melamine formaldehyde resin at a ratio of acrylic resin-to-melamine formaldehyde of about 70 parts acrylic for 30 parts melamine. The liquid coating composition further included conventional pigments, fillers, etc., and contained a solvent consisting of 80 – 85% water and 15 – 20% of water-miscible organic solvents to provide a nonvolatile or solids content of 25% suitable for spray application employing an air atomizing spray gun. An evaluation of the liquid coating composition revealed a no-sag limit of about 32% nonvolatiles as determined by applying liquid films on a vertical panel surface by a doctor blade of a thickness of about 10 mils. The gel point of this coating composition is approximately 40% nonvolatiles.

Test panels were coated by operating the spray gun at a standard commercial spray rate of 17 fluid ounces per minute employing secondary air at a flow rate of 150 standard cubic feet per minute (SCFM) at 230° F. and at a pressure of 0.5 pounds per square inch gauge. A liquid film of from 6 to 10 mils was applied in four separate spray applications, each applying from about 1.5 to 2.5 mils, separated by a dwell period of 60 seconds. Spray application was performed by holding the discharge end of the nozzle approximately 14 inches from the panel being coated. The environment of the spray booth was adjusted to a temperature of 25° C. and a relative humidity of about 85%. The aqueous paint system is generally characterized as satisfactory for application to substrates when the relative humidity of the paint spray atmosphere ranges from about 30% up to 60% ambient temperatures of 65° F. to 90° F. When the relative humidity exceeds about 65%, objectionable sagging occurs. This problem was entirely corrected by employing the apparatus and method of the present invention utilizing the conditions as hereinabove set forth, consistently producing test panels having a uniform run and sag-free surface coating.

The specific conditions employed in the foregoing example will vary dependent upon the nonvolatile content of the water-thinnable paint system supplied to the spray gun. At a no-sag limit of about 32% nonvolatiles for the specific coating composition evaluated, the lower the nonvolatile content of the sprayed coating formulation, the more BTUs that must be supplied in the secondary air entering the shroud to effect a greater vaporization of water from the liquid droplets during the course of their travel from the nozzle to the surface. For example, the liquid coating composition at a sprayable nonvolatile content of 30% and at a spray rate of 17 fluid ounces per minute requires an input of 80 BTU per minute which can be supplied by secondary air at a temperature of 95° F. and a flow rate of 260 SCFM, or by secondary air at a lower flow rate but at a higher temperature, such as, for example, 225° F. at 30 SCFM. A nonvolatile content of 25% of the sprayable coating composition to attain a no-sag point on the panel surface requires a heat input of 280 BTU per minute, which can be supplied by secondary air at a temperature of 138° F. and a flow rate of 260 SCFM, or secondary air at 275° F. and at a flow rate of 80 SCFM. At a nonvolatile content of only 22.5%, 390 BTU per minute are required which can be supplied by secondary air at 165° F. at 260 SCFM, or at 285° F. at 110 SCFM. In the system as typically shown in FIG. 1 of the drawings, a flow rate of 30 SCFM, secondary air at 225° F. is achieved at a pressure of only 0.003 psig; a flow rate of 80 SCFM is achieved at a pressure of 0.03 psig; a flow rate of 110 SCFM is achieved at a pressure of 0.07 psig; and a flow rate of 260 SCFM is achieved at 0.3 psig. The foregoing data further clarifies the pressure, temperature, volume relationship of the secondary air required for spray application of a typical water-thinnable acrylic enamel having a no-sag limit of about 32% NV.

While it will be apparent that the invention as herein described is well calculated to achieve the benefits and advantages hereinabove set forth, it will be appreciated that the invention is susceptible to modification, variation and change without departing from the spirit thereof.

What is claimed is:

1. A method for spray application of solvent-thinned coating compositions to the surface of a substrate which comprises the steps of discharging a solvent-thinned liquid coating composition through nozzle means in the form of a directionally-oriented spray comprised of a plurality of liquid droplets toward a surface to be coated, encompassing said spray in the vicinity of its origination in a shroud and substantially precluding the entrainment of ambient air in said spray, introducing a supply of secondary air at low pressure and under controlled conditions into said shroud in a manner to encompass said nozzle means and to become entrained in said spray effecting a controlled vaporization of a portion of the solvent in the liquid droplets during the course of their travel from said nozzle means to the surface in a magnitude to increase the nonvolatile content of the deposited liquid coating films to a level above the no-sag point and below the gel-point of the liquid film, and controlling at least one of temperature and humidity of said secondary air to obtain the desired magnitude of vaporization of solvent.

2. The method as defined in claim 1, including the further step of controlling the flow pattern of the secondary air introduced into said shroud.

3. The method as defined in claim 1, including the further step of heating the liquid coating composition to an elevated temperature prior to discharge in the form of a spray.

4. The method as defined in claim 1, in which the step of discharging the solvent-thinned coating composition in the form of a spray includes the step of fragmentizing the liquid coating composition by impingement of a high velocity jet of atomizing air.

5. The method as defined in claim 4, including the further step of heating the atomizing air to a controlled elevated temperature.

6. The method as defined in claim 1 in which the liquid coating composition comprises a water-thinnable paint discharged at a nonvolatile content of about 25% to about 28% and wherein the step of introducing a supply of secondary air under controlled conditions is performed to deposit a liquid film on the surface of a substrate having a nonvolatile content above about 32% and below about 40%.

7. An apparatus for spray application of solvent-thinned coating composition comprising a spray gun including an air-atomizing nozzle for discharging a solvent-thinned liquid coating composition in the form of a directionally-oriented spray comprised of a plurality of liquid droplets, a shroud mounted on said spray gun and comprising a three-dimensional housing including a first wall portion positioned rearwardly of the point of discharge of said nozzle and a second wall portion projecting forwardly of said first wall portion and in radially spaced encircling relationship around the axis of discharge of said nozzle, said second wall portion terminating at its forward end at a position spaced outwardly of the point of discharge of said nozzle and defining a discharge port through which the spray is adapted to be discharged from said shroud, said shroud mounted in fitting relationship on said spray gun in encompassing relationship around said nozzle to substantially preclude entry of ambient air into the spray of liquid droplets in the vicinity of discharge of the liquid coating composition from said nozzle, said shroud formed with an inlet port disposed in communication with the interior thereof, supply means connected to said inlet port for supplying secondary air to the interior of said shroud at low pressure and under controlled conditions and quantities sufficient to maintain the interior of said shroud filled with secondary air and to supply the quantity of secondary air extracted from said shroud by entrainment in the spray, and control means in said supply means for controlling at least one of temperature and humidity of said secondary air supplied to said shroud to effect a controlled vaporization of the solvent from the liquid droplets in the spray to increase the nonvolatile content of the deposited liquid coating film to a level above the no-sag point and below the gel-point of the liquid film.

8. The apparatus as defined in claim 7, in which said shroud includes baffle means for controlling the flow pattern of the secondary air introduced therein to achieve a desired spray pattern.

9. The apparatus as defined in claim 7, wherein said supply means includes means for controlling the volume of secondary air supplied to said shroud.

* * * * *